US006736660B2

(12) United States Patent
Ku

(10) Patent No.: US 6,736,660 B2
(45) Date of Patent: May 18, 2004

(54) MEMORY MODULE CONNECTOR FOR HORIZONTAL INSERTION

(75) Inventor: Yueh-Chu Ku, Taipei (TW)

(73) Assignee: Egbon Electronics Ltd., Taipei (TW)

( * ) Notice: Subject to any disclaimer, the term of this patent is extended or adjusted under 35 U.S.C. 154(b) by 0 days.

(21) Appl. No.: 10/252,333

(22) Filed: Sep. 23, 2002

(65) Prior Publication Data

US 2004/0058577 A1 Mar. 25, 2004

(51) Int. Cl.[7] ..... H01R 13/62

(52) U.S. Cl. ..... 439/328; 439/157; 439/352; 439/570; 439/633; 439/740

(58) Field of Search ..... 439/328, 352, 439/153, 157, 160, 570, 571, 633, 680, 740, 747, 748, 756, 759, 326, 327, 629, 630, 79, 64

(56) References Cited

U.S. PATENT DOCUMENTS 5,710,693 A * 1/1998 Tsukada et al.
5,738,532 A * 4/1998 Takano et al.
5,876,220 A * 3/1999 Yeh
6,080,000 A * 6/2000 Baker et al.

* cited by examiner

*Primary Examiner*—Chau N. Nguyen
*Assistant Examiner*—Nguyen T. Ha
(74) *Attorney, Agent, or Firm*—Jackson Walker LLP

(57) ABSTRACT

A memory module connector for horizontal insertion is disclosed. The device is formed by a long and narrow connector body, which has a horizontally directed connector slot on the lengthwise section, and the connector body has multiple terminal posts having a right-angle bent in the middle section to form an inverted "L" shape structure. One end of each terminal post is lined on the inner wall of the connector slot with a matching pair on opposing slot walls, and the other end of each terminal sticks out from the bottom of the connector body and penetrates the corresponding position on the motherboard. According to the connector design of the present invention, memory module can be inserted into the motherboard in horizontal direction, allowing for close fitting in enclosure with height or thickness limitations.

3 Claims, 5 Drawing Sheets

MEMORY MODULE CONNECTOR FOR HORIZONTAL INSERTION

BACKGROUND OF THE INVENTION

1. Field of the Invention

The present invention relates to a memory module connector that enables horizontal insertion of a memory module into the connector for mating thereto, in particular a connector which has horizontally directed connector slots on the lengthwise section for installation of a memory module onto a motherboard in the horizontal direction, especially suitable for enclosure with height or thickness limitations.

2. Description of Related Arts

A conventional motherboard (70) is shown in FIG. 5 which shows multiple sets of memory module connector (80) disposed at one corner of the motherboard for memory expansion use. Currently memory modules (81) are inserted onto the motherboard in the vertical direction. Since most of the casing designs for desktop computers have reserved adequate space inside for installation of conventional memory modules (81) and the motherboard (70), there is no special limitation with regard to the form factor or height for assembly of a motherboard (70) with conventional memory (81).

Memory module connectors for vertical insertion are still widely used in the computer industry. But, the digital technology is gradually making an impact on conventional equipment and instruments, as manufacturers start to put microprocessors and other digital components in their products in an attempt to enhance their computing capabilities and functionality. Since they have to fit all components into a streamlined body, the bulky casing like the desktop computer is certainly not ideal for equipment and instrument. The design of the circuit board for these equipment and instrument is even more challenging than that in desktop computers, where the height and thickness of components are definitely key issues affecting the outcome of the circuit board design. If memory module connectors can be built for horizontal insertion, the space problem for the space-saving equipment and instrument is solved in large part.

SUMMARY OF THE INVENTION

The main object of the present invention is to provide a memory module connector that enables horizontal insertion of memory module onto the motherboard for mating thereto, whereby these memory modules can be successfully installed on printed circuit boards which can fit into a streamlined body or other applications with height limitations.

The connector body under the present invention is built with a long and narrow connector slot on the lengthwise section, which enables horizontal insertion of a memory module onto the motherboard.

The connector body has multiple terminal posts which are bent in the middle forming a horizontal section on one end and a vertical section on the other end, with an inverted "L" shape structure, wherein the horizontal section of each terminal post is paired up with another one on opposing slot wall, so that the metallic fingers on the bottom edge of a memory module can be placed in contact with the horizontal section of the terminal posts when successfully inserted into a connector slot; and the vertical section of each terminal post sticks out from the bottom of the connector body and penetrates the corresponding position on the motherboard to establish electronic connection with the internal circuit.

Although the memory module is to be inserted into the connector in a horizontal direction, the connector body is still mounted perpendicularly over the motherboard, such that the flat surface of the memory module is to be kept parallel to the motherboard on which the memory module is installed.

The design of the memory module allows for considerable space saving so that the assembled circuit board can be fitted in the streamlined body of an equipment or instrument.

The memory module connector has a fixing means located on both ends of the connector body, which comprises two finger clamps pivotally mounted on each end of the connector body, each having a prong at the tip facing inward. The lateral side on both ends of the memory module each has a notch to match against the prong on the finger clamp.

The finger clamp is used to lock the memory module firmly into the connector slot by engaging the two prongs in the corresponding notches on both ends of the memory module for a secure mounting.

The features and structure of the present invention will be more clearly understood when taken in conjunction with the accompanying figures.

DETAILED DESCRIPTION OF THE PREFERRED EMBODIMENT

Figure 1:
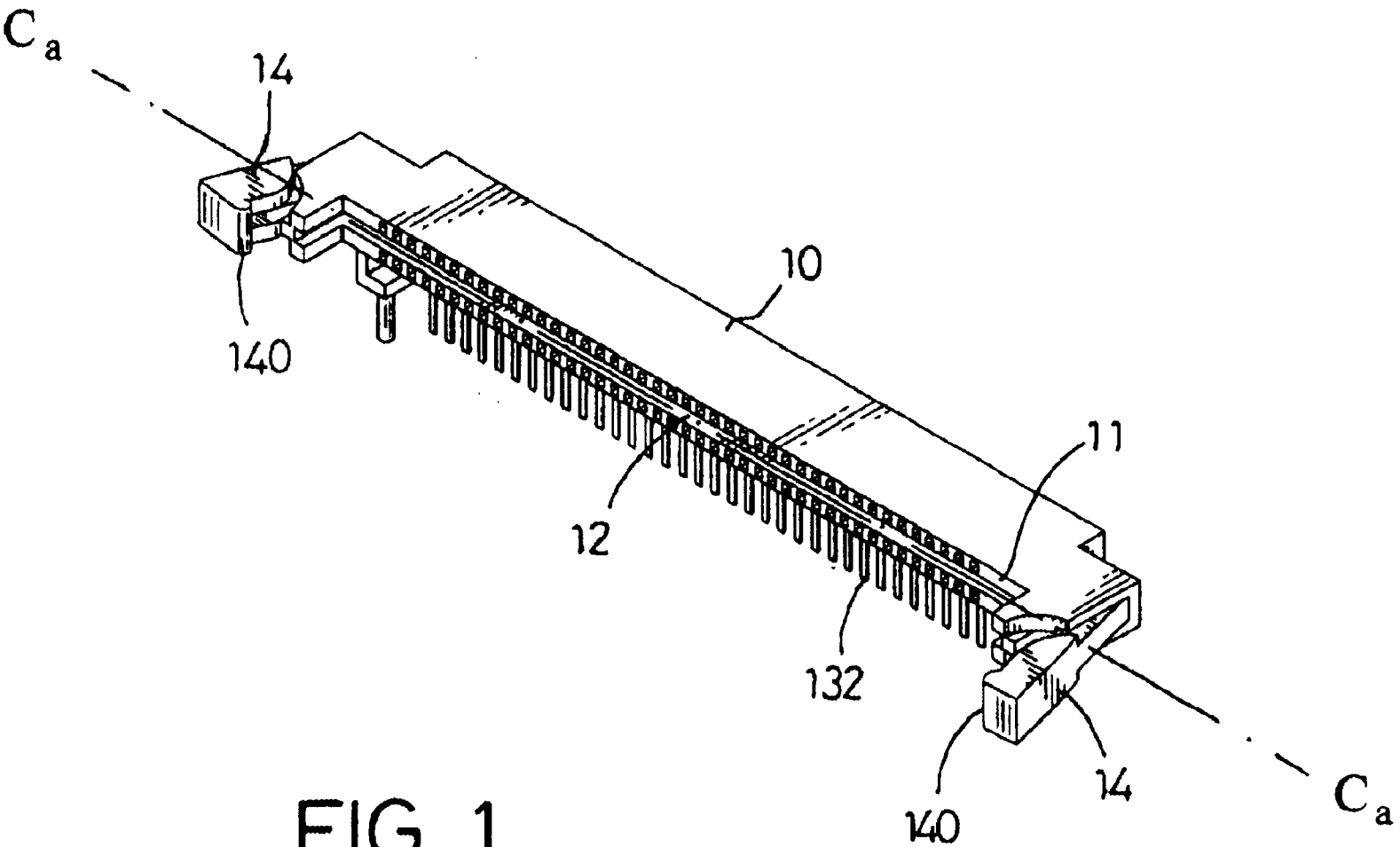
FIG. 1 is a perspective view of the present invention.

FIG. 1 shows the structure of the memory module connector in accordance with the present invention that enables horizontal insertion of memory module into the connector slot on the motherboard for mating thereto.

The memory module connector is formed by a connector body (10). The connector body (10) has a narrow connector slot (12) on the lengthwise section thereof which is fixed on the motherboard (not specially identified) by means of multiple terminal posts (13) penetrating the board surface.

The upper and lower walls of the narrow connector slot (12), being part of the connector body (10), are interconnected on both ends creating a hollow space in the center. A longitudinal axis (Ca) extends through the center of the connector slot and is positioned parallel to a longitudinal axis (Ba) of the motherboard 20 (see FIG. 3).

Figure 2:
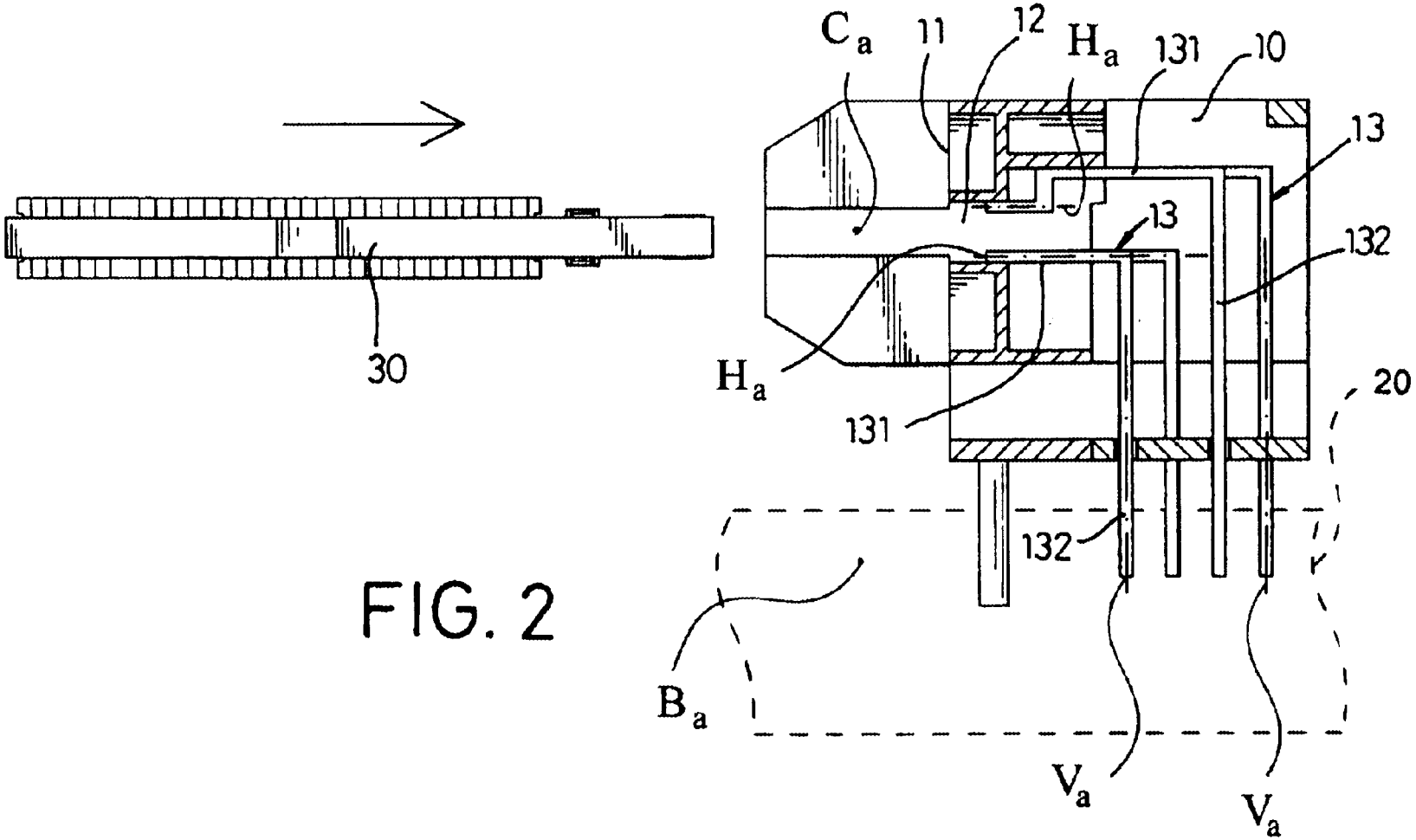
FIG. 2 is a cross-sectional view of the invention.

The terminal posts (13) are bent in the middle at an approximate 90° angle to form an inverted "L" shape structure having a horizontal section (131) on one end having a longitudinal axis (Ha) perpendicular to the longitudinal slot axis (Ca) and a vertical section (132) on the other end having a longitudinal axis (Va) which is perpendicular to both the slot axis Ca and the motherboard axis Ba, as shown in FIG. 2.

The horizontal section (131) of each terminal post (13) is attached to the inner surface of lengthwise slot wall and paired up by another terminal post (13) on the opposing slot wall, so that the horizontal section (131) of all terminal posts

(13) are lined up on the lengthwise and inner edge of slot wall for the full length thereof.

The vertical section (132) of each terminal post (13) sticks out or projects vertically from the bottom of the connector body (10) and penetrates the corresponding position on the motherboard to establish electronic connection with the internal circuit thereof.

The connector body (10) has a fixing means for inserted memory modules (30), which is formed by two finger clamps (14) pivotally mounted on each end of the connector body (10), wherein the finger clamp (14) has a prong (140) at the tip facing inward, which allows the clamp (14) to be engaged in a corresponding notch (31) on the lateral side of the memory module (30) for a secure mounting.

Figure 3:
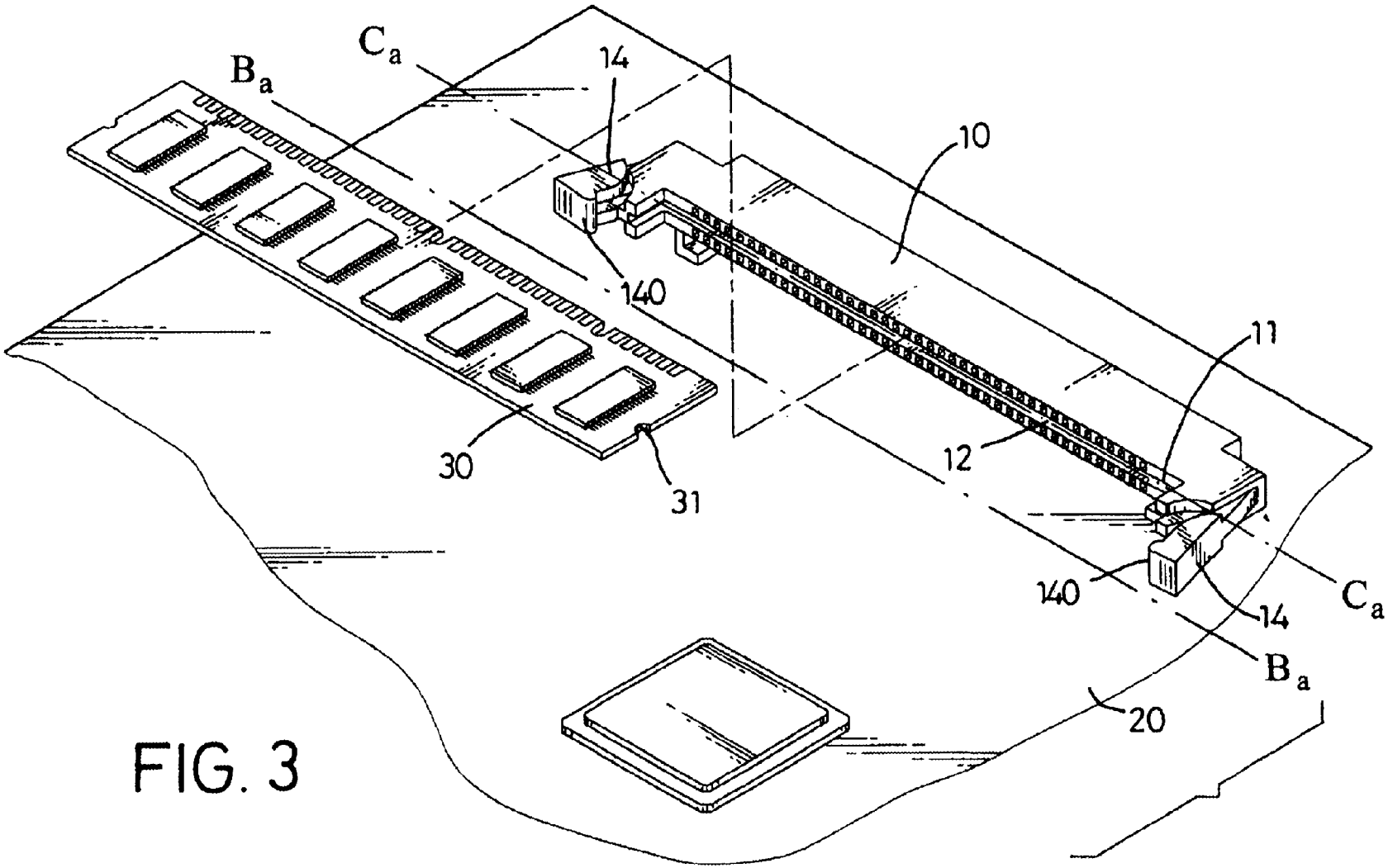
FIG. 3 is a diagram showing a memory module being inserted into the memory module connector on a motherboard.

The structure of the memory module connector has been described above, and the method of inserting a memory module into the connector is to be illustrated in conjunction with FIG. 3.

Figure 4:
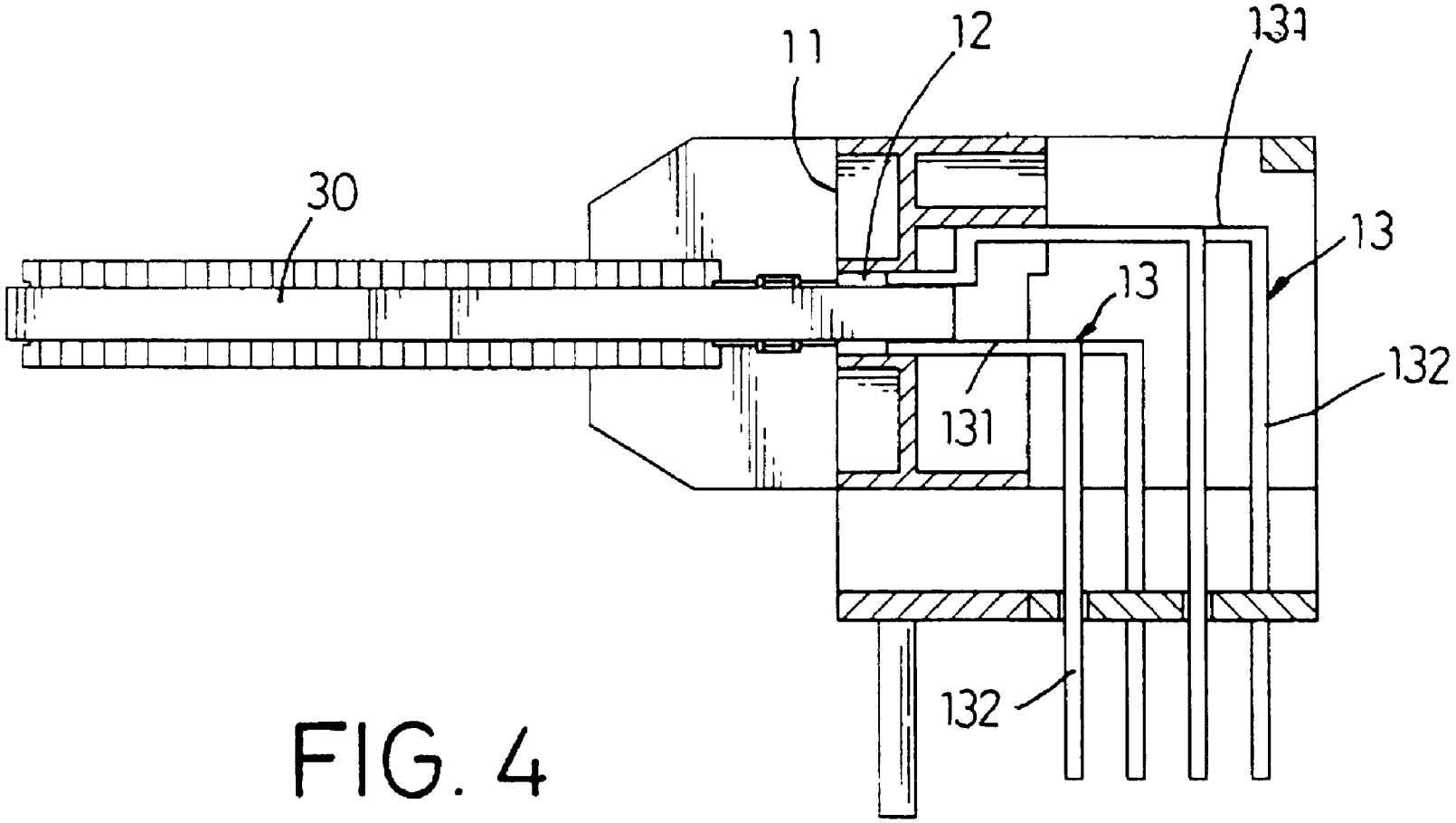
FIG. 4 is a cross-sectional view of the connector assembly.
Figure 5:
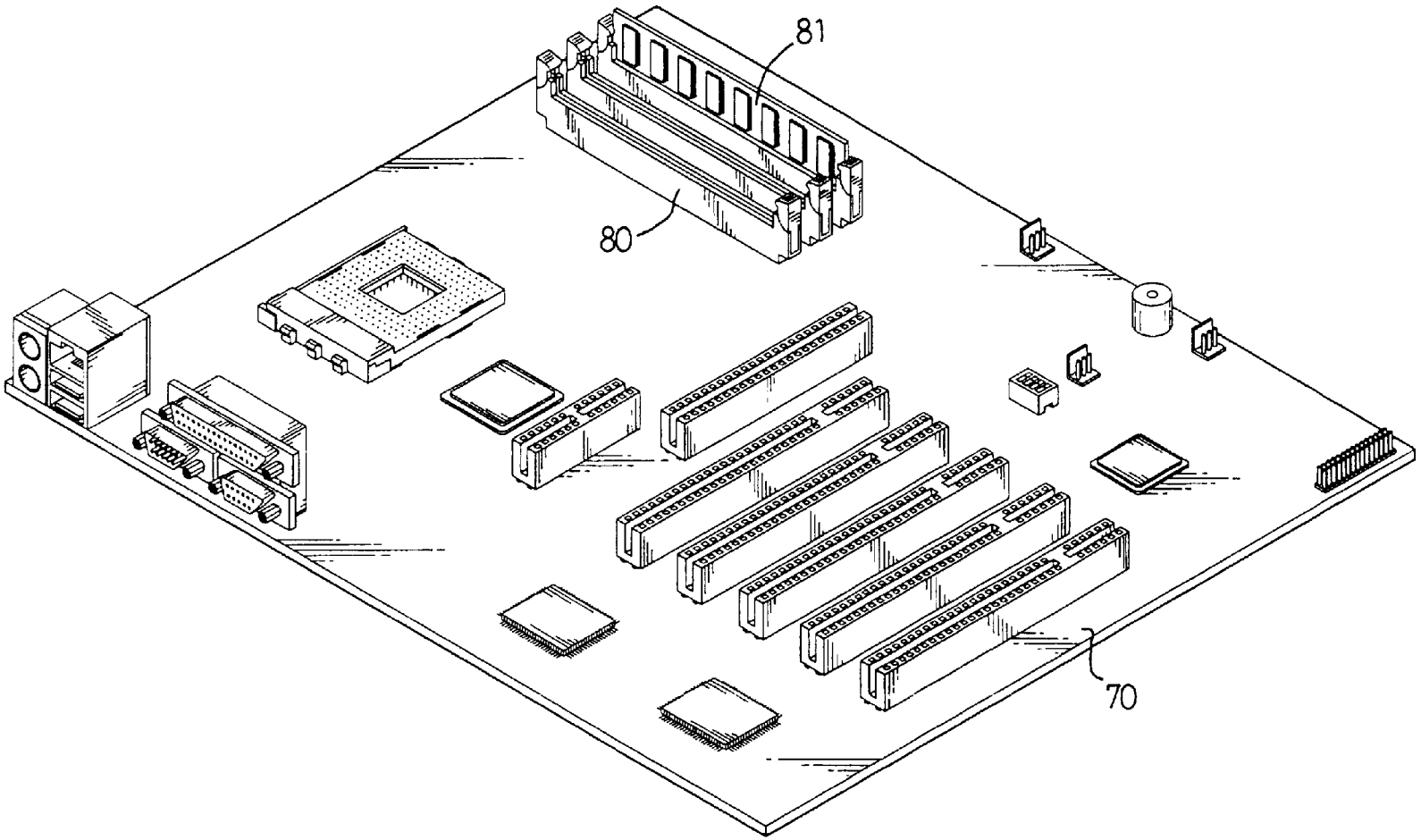
FIG. 5 PRIOR ART
FIG. 5 is a diagram of a conventional motherboard with vertically directed memory module connectors.

When the memory module (30) is inserted into the connector slot (12), the metallic fingers on the bottom of the memory modules (30) make contact with the horizontal section (131) of terminal posts (13) lining the inner edge of both slot walls, as shown in FIG. 4, thus enabling the memory module to establish electronic connection with the internal circuit of the motherboard (20).

The lateral side of the memory module (30) on both ends each has a notch (31) which is matched with a prong (140) on the finger clamp (14). When a memory module is properly inserted into the connector slot (12), the prong (140) of the finger clamp (14) locks against the notch (31) of the memory module (30), permitting a secure mounting of the memory module (30) onto the motherboard (20).

Given that the connector body (10) is perpendicularly installed on the motherboard (20), and the connector slot (12) is horizontally directed, when a memory module (30) is successfully inserted into the connector slot (12) of the memory module connector, the memory module (30) is kept above and parallel to the motherboard (20). In such conditions, the space requirement for the assembled motherboard (20) can be reduced.

The present invention enables a memory module to be assembled on printed motherboards for equipment and instrument with streamlined body or other space-saving applications, giving ways for more efficient use of internal space. The new connector design is clearly more advantageous for assembling circuit board used in equipment and instrument, making the memory module connector especially suitable in applications with height or thickness limitations.

The foregoing description of the preferred embodiments of the present invention is intended to be illustrative only and, under no circumstances, should the scope of the present invention be so restricted.

What is claimed is:

1. A memory module connector for horizontal insertion of a memory module comprising:

a connector body having a narrow connector slot on a lengthwise section of the body, the connector slot having a longitudinal axis horizontally directed and positioned in parallel to a longitudinal axis of a motherboard on which the memory module is mounted; and a first set of lower terminal posts attached to a lower wall of the connector slot and a second set of upper terminal posts attached to an upper wall of the connector slot, each of the lower and upper terminal posts bent at an approximate 90° angle in the middle to form a horizontal section on one end having a longitudinal axis which is perpendicular to the longitudinal slot axis and a vertical section on the other end having a longitudinal axis which is perpendicular to both the longitudinal slot axis and the motherboard longitudinal axis, each upper and lower terminal post having an inverted "L" shape, the horizontal section of each lower terminal post spaced apart from a cooperating horizontal section of an upper terminal post attached to the upper wall of the connector slot, the vertical sections of each terminal post projecting vertically out from a bottom of the connector body.

2. The memory module connector for horizontal insertion as claimed in claim 1, wherein the memory module connector employs a fixing means for locking a memory module securely into the connector slot.

3. The memory module connector for horizontal insertion as claimed in claim 2, wherein the fixing means comprises two finger clamps pivotally mounted on both ends of the connector slot, each of which has a prong on the tip facing inward to match against a corresponding notch from the lateral side of a memory module for a secure mounting.

* * * * *